US006532708B1

(12) United States Patent
Baerveldt

(10) Patent No.: US 6,532,708 B1
(45) Date of Patent: Mar. 18, 2003

(54) EXPANSION AND SEISMIC JOINT COVERS

(76) Inventor: Konrad Baerveldt, 180 Highbourne Road, Toronto, Ontario (CA), M5P 2J7

( * ) Notice: Subject to any disclaimer, the term of this patent is extended or adjusted under 35 U.S.C. 154(b) by 0 days.

(21) Appl. No.: 09/654,932

(22) Filed: Aug. 31, 2000

(30) Foreign Application Priority Data

Jan. 18, 2000 (CA) ..... 2296228

(51) Int. Cl.[7] ..... E04B 1/682

(52) U.S. Cl. ..... 52/396.05; 52/167.7; 52/395; 52/402; 404/47; 404/68

(58) Field of Search ..... 52/167.1, 167.7, 52/395, 396.04, 396.05, 402; 404/47, 50, 56, 68

(56) References Cited

U.S. PATENT DOCUMENTS 4,453,360 A * 6/1984 Barenberg ..... 52/396
5,607,253 A * 3/1997 Almstrom ..... 404/47
6,102,407 A * 8/2000 Moriya et al. ..... 277/316

* cited by examiner

*Primary Examiner*—Yvonne M. Horton
(74) *Attorney, Agent, or Firm*—Randall J. Knuth

(57) ABSTRACT

A seismic/expansion joint seal and cover comprises a cover plate, and a central spine extending downwardly from said cover plate. At least one layer of a resilient compressible foam sealant is provided on each side of the spine.

8 Claims, 6 Drawing Sheets

EXPANSION AND SEISMIC JOINT COVERS

BACKGROUND OF THE INVENTION

The present invention relates to the field of seismic and expansion joint covers.

FIELD OF THE INVENTION

Expansion and seismic joint covers are, essentially, covers or mechanism devices to cover expansion and seismic joints to provide pedestrian or vehicular passage over a joint, and provide a smooth transition from one slab to another, while not inhibiting joint movement or restricting this movement as a result of the mechanism employed. Generally, the mechanisms employed to position the expansion/seismic joint cover over the joint are either of a mechanical nature or make use of an elastic and recoverable element to provide the impetus (spring-memory or return-force) to maintain the joint cover in a median position relative to the joint movements occurring. These movements may be experienced in all three planes, such as expansion and contraction, deflection and shear of the joint.

Various mechanisms are thus employed to deal with this three directional movement and the mechanism to stabilize the expansion joint cover and restore it into a "neutral position" relative to the movement that has taken place.

FIG. 1 is a typical prior art expansion/seismic joint cover manufactured by Migua Fugensysteme GmbH & CO. KG, in Germany particularly for Seismic Joints. As can be seen, this has a cover plate extending across the width of the joint to allow for both vehicular and pedestrian traffic. As a self-centring mechanism, it utilizes the recovery ability of elastomeric extrusions. These extrusions exert the return force required to reposition the cover plate as a result of movements occurring in the joint. The dotted line, seen midway through the joint, is a horizontal bar set across the width of the joint to act as a stabilizing element for the elastomeric extrusions in the centre. It is there to add stability to the joint and allow the central (metallic) part of the joint to be fastened to the cover plate, prior to its (the horizontal bar) removal. This expansion/seismic joint cover is intended to be watertight. The waterproofing is confined substantially to the upper surfaces of the joint immediately below the cover plate. However, once the horizontal (stabilizing) bar is removed, remedial work on the joint is difficult as removal of the cover plate will allow the central portion of the joint to collapse as it is no longer supported (by the horizontal bar).

FIG. 2 shows an expansion/seismic joint made by Watson Bowman Acme Corp., in the U.S.A. In this design, the cover plate is attached to a scissors-type mechanical device immediately below it. The scissors-type mechanism is similar to a "pantograph" or expanding scissors type hot-plate mat. In other words, a scissors-type movement contained between nylon bearings and running the length of the joint. In this type of mechanism, an increase or decreases in the joint width will result in the repositioning of the cover plate along the centre line. However, this expansion/seismic joint cover is not watertight immediately below the cover plate—as is the case with the expansion/seismic joint cover in FIG. 1. Thus, an elaborate system of gutters attempts to provide a solution to the watertight issue. The joint, in effect, suffers from three major problems. Firstly, an inability to inspect and clean out the joint other than by removal of the whole joint assembly (the scissors mechanism prevents direct access into the joint below the cover or slide plate).

Secondly, the ingress of waterborne salts into the joint will seriously affect the long term performance of the self-centring mechanism. Thirdly, the joint design lacks "watertight properties".

The above prior art illustrates two objects of the present invention. The first is that the cover plate should be removable to permit inspection of the joint below. The second object is that the joint should be watertight at, or immediately below, the line of waterproofing that is applied to the deck. This will ensure a waterproofing line of integrity across both decks, on either side of the joint, and through the actual joint itself.

It can be seen from FIGS. 1 and 2 that the emphasis, until this point in time, has been to utilize either a mechanical mechanism or elastomeric extruded profile as the correcting or centring element required to maintain the cover plate in its correct position relative to joint movement occurring beneath it. In other words, the cover plate cannot be allowed to merely sit on the surface of the joint but must be guided to maintain a central position or neutral position relative to the joint movement occurring.

SUMMARY OF THE INVENTION

In the present invention, the use of an impregnated foam sealant as an elastic recovery or return force mechanism has the dual advantage that the system can remain watertight immediately below the level of the cover plate while at the same time the impregnated foam sealant acts as the return force or stabilizing element for the cover plate.

In the present invention, then, relates to a seismic/expansion joint seal and cover comprising a cover plate, a central spine extending downwardly from said cover plate, and at least one layer of a resilient compressible foam sealant on each side of said spine.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
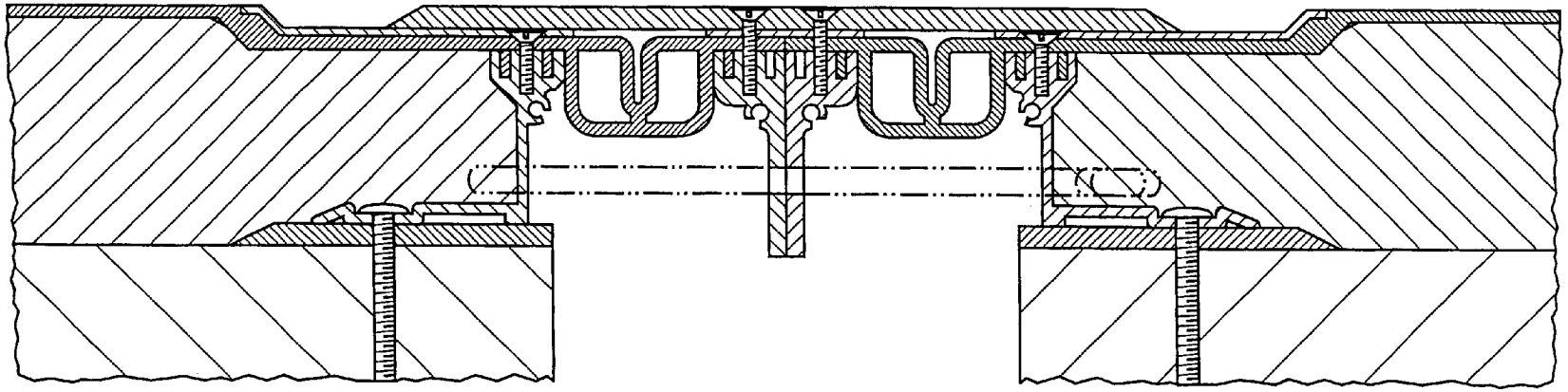
FIG. 1 PRIOR ART
FIG. 1 is a cross-sectional view of a prior art seismic/expansion joint cover made by MIGUA.
Figure 2:
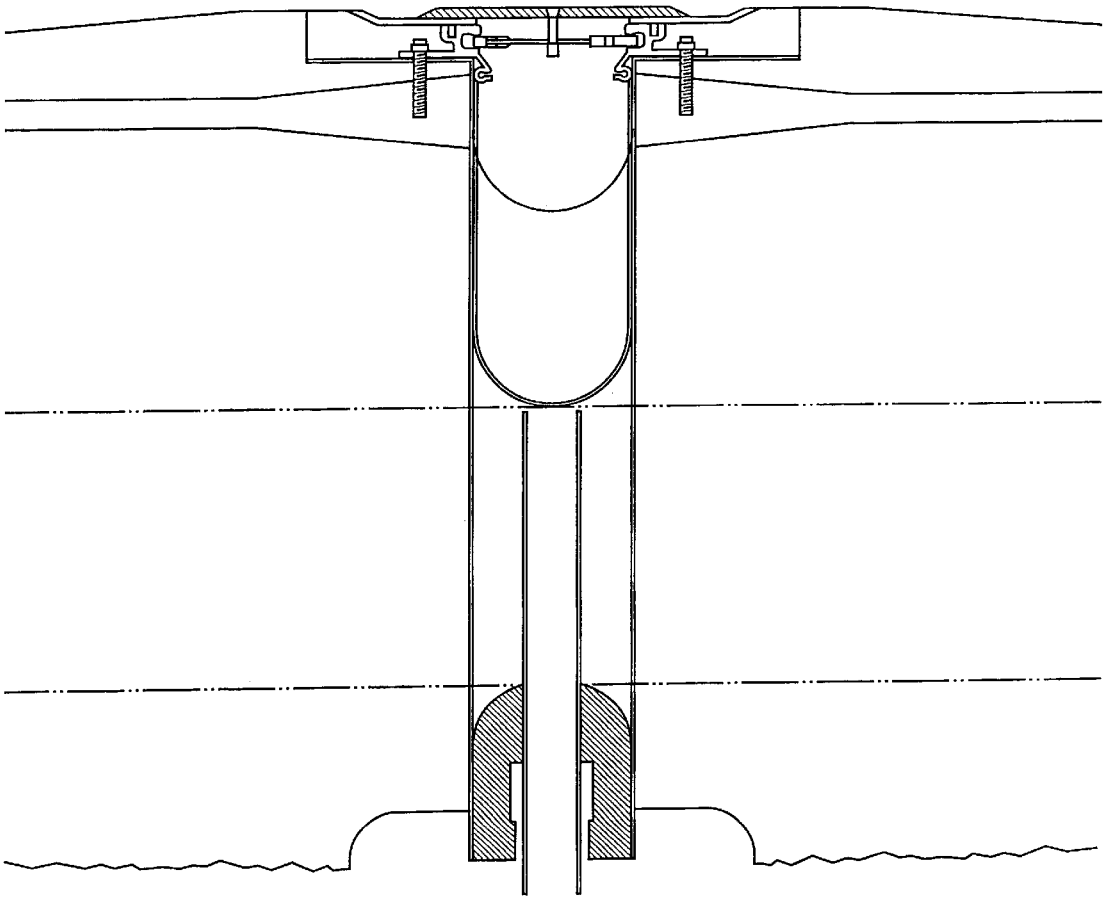
FIG. 2 PRIOR ART
FIG. 2 is a cross-sectional view of a prior art seismic/expansion joint cover made by Watson Bowman.
Figure 3:
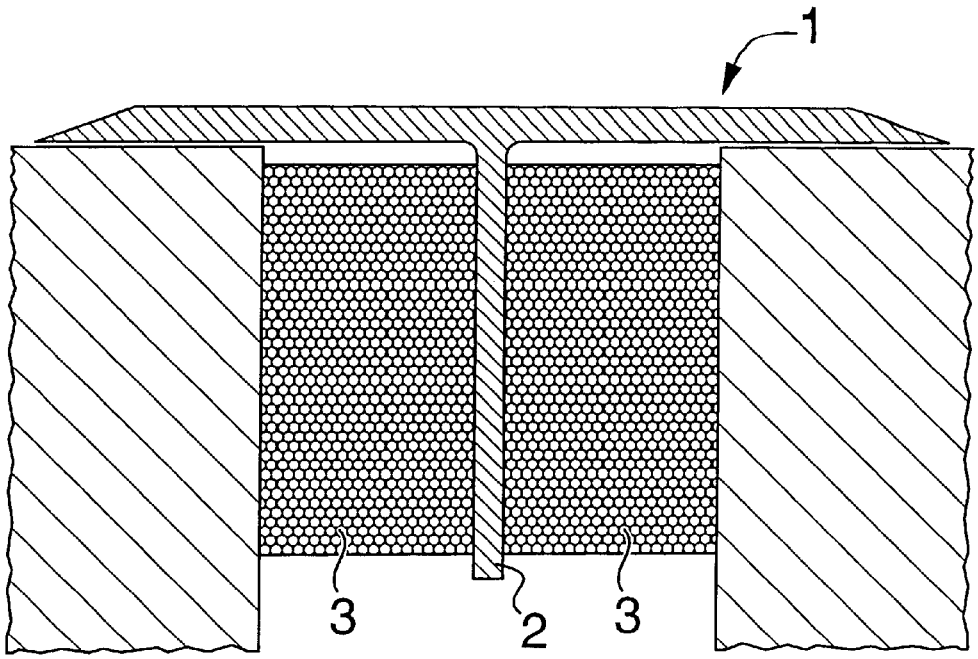
FIG. 3 is a cross-sectional view of a first embodiment of the present invention.

FIG. 3 illustrates the simplest form 1 of the present invention. This essentially consists of a T-piece 2 that acts as both the cover/slide plate and mechanism for the self-centring of the cover plate. The leg of the T extends into the joint. Its length is dependent on joint dimensions and the size of pre-compressed expanding foam sealant 3 placed on either side of the leg. As can be seen from FIG. 3, impregnated expanding foam sealant such as 20H™ System or GREYFLEX™ from Emseal Corporation is placed on either side of the leg of the T. Thus, the system is in equilibrium if the expansion force of the impregnated expanding foam sealant to the left of the T is equal or equivalent to that being exerted by the impregnated expanding foam sealant to the right of the T. The system, such as, can be considered "at rest". Should the joint experience an extension due to a decrease in temperature or as a result of other movements, the impregnated expanding foam sealant will have to fill a greater void or distance between the faces of the joint. Due to its expanding nature, it will do so in relation to the movement experienced and thus come to a new "rest" position. In this new rest position, forces to the left of the T will balance those to the right of the T thus enabling the cover plate/slide plate to remain centred over the joint.

Figure 4:
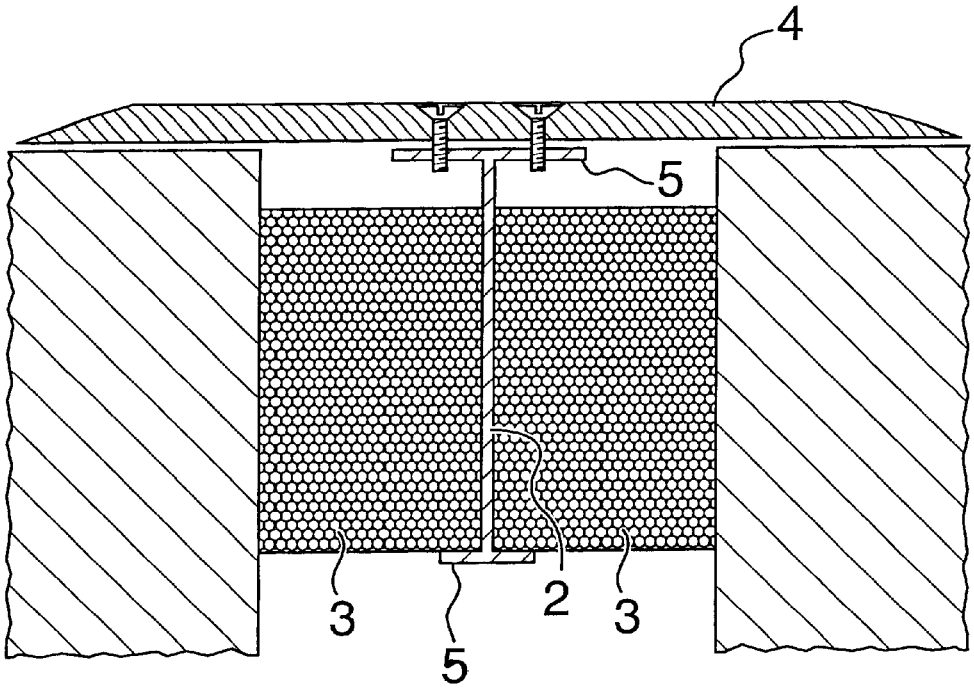
FIG. 4 is a cross-sectional view of a second embodiment of the present invention.

However, the FIG. 3 configuration does not allow for an inspection of the joint beneath the slide plate as the T section is one solid piece. Therefore, provision must be made, as in FIG. 4 onwards, for the ability to remove the top cover plate/slide assembly from that portion contained within the throat of the joint. This is achieved as shown in FIG. 4. In addition, the section contained in the joint may be provided with upper and lower base flanges 5 (as shown) to position the impregnated expanding foam sealant 5 more accurately and, in addition, enable the vertical element 2 to be secured to the cover plate/slide plate 4.

Figure 5:
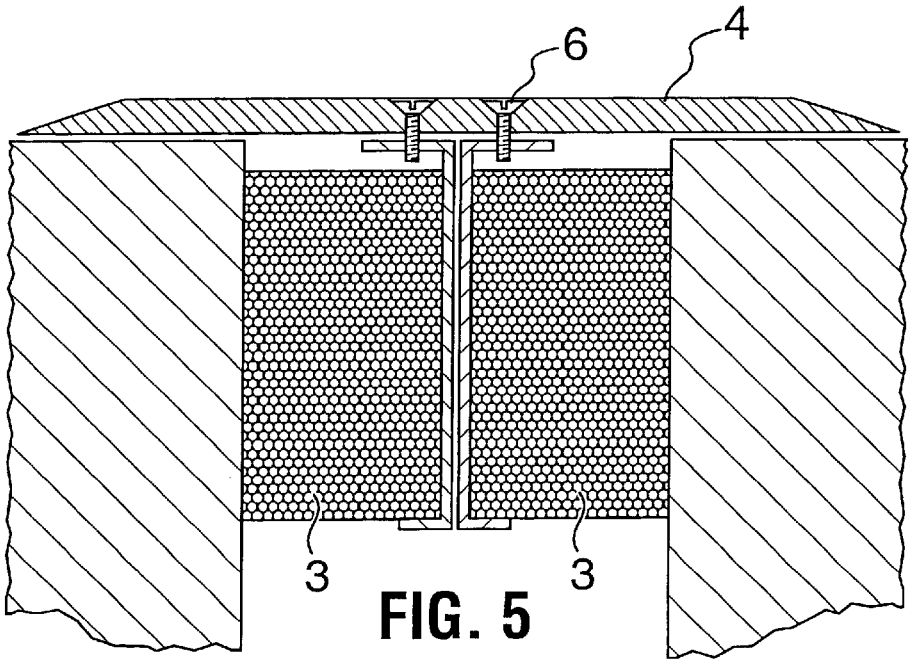
FIG. 5 is a cross-sectional view of a third embodiment of the present invention.

FIG. 5 is an alternate embodiment that allows for the removal of the cover plate/slide plate 4. This design allows for the fact that irregularities in joint construction may exist in regard to both the horizontal and vertical joint sizing parameters. In other words, joint sides may not be perfectly parallel to one another or equidistant from one another. The joint design criteria may not be met during actual field construction of the joint. In this case, the expansion of the impregnated expanding foam sealant on the left of the T piece may not be perfectly matched with the expansion characteristics of the impregnated expanding foam sealant on the right hand side of the T piece. This will be due to joint irregularity, in width, vertical, and horizontal alignment, occurring during the construction process. This situation should be corrected to allow the cover plate/slide plate to remain (slide) in contact with both opposing slabs that form the upper surface of the joint. The configuration of FIG. 5 will allow, by tightening of the respective screws 6, the ability to pull down the slide/cover plate to the degree that is necessary and so enable it to rest on one or other side of the joint in the correct manner.

Figure 6:
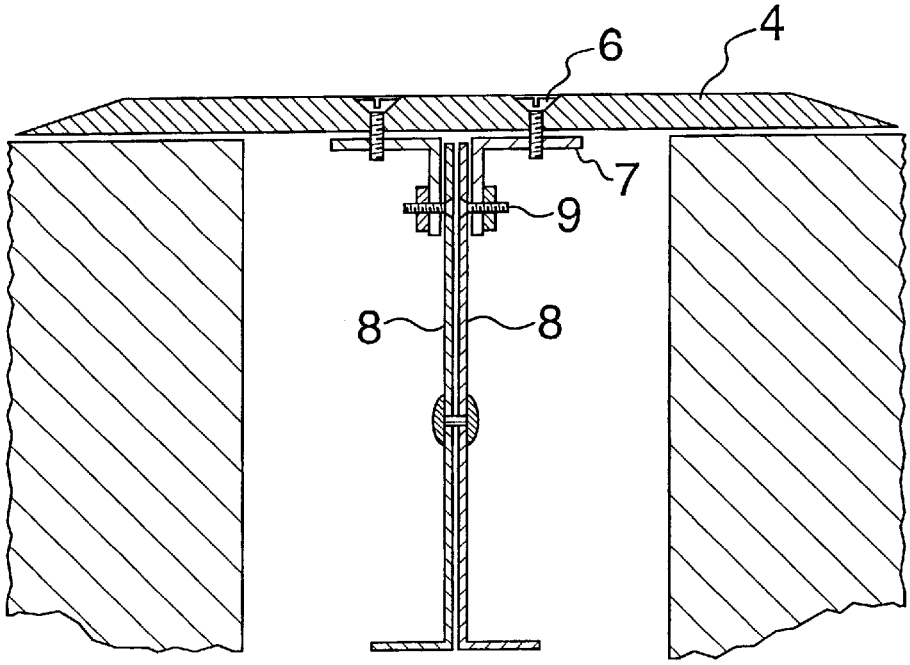
FIG. 6 is a cross-sectional view of a fourth embodiment of the present invention.

The embodiment of FIG. 6 is an adaptation of that shown in FIG. 5. However, in this case, the means to adjust the final position of the cover plate/slide plate is moved to immediately below the cover/slide plate.

It will be observed that the upper base flange in the embodiment of FIG. 6 is incorporated in an angulated portion 7 that is adjustable relative to the central spine 8 by means of vertically extending slots in the spine and/or the angulated portion, through which bolts 9 extend, which can be tightened after the angulated portion is at the correct height. It will be appreciated that in selecting the material from which the angulated portion is to be fabricated, consideration should be given to flexibility, since a joint may be somewhat uneven along its length. Foam 3 is not shown in FIG. 8 for clarity of illustrating the other elements.

Figure 7:
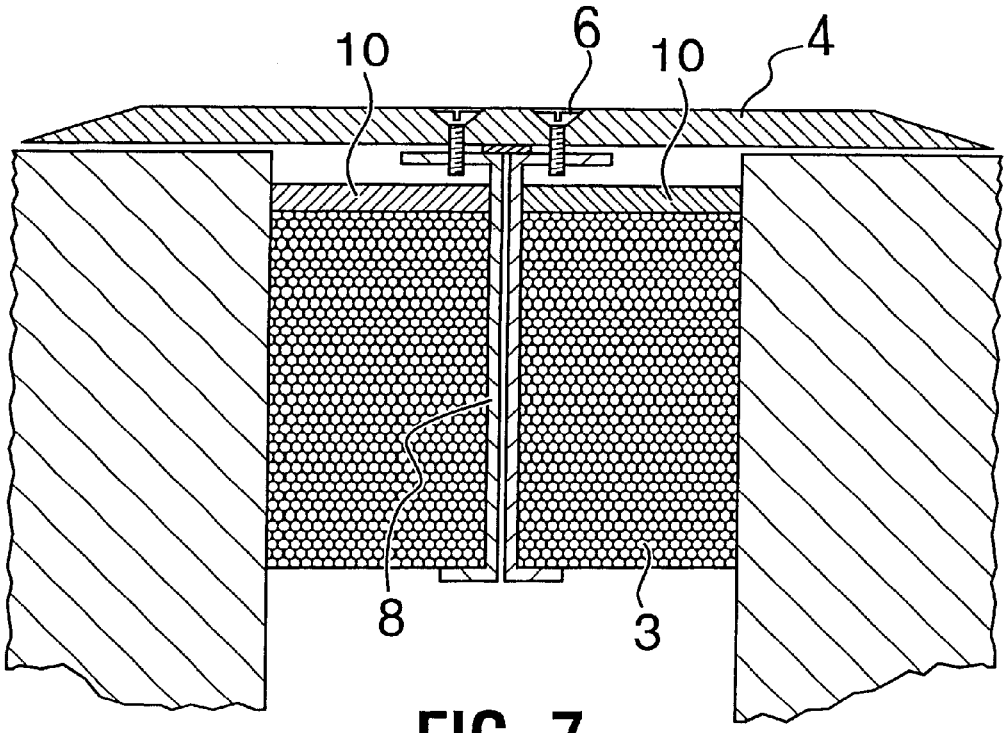
FIG. 7 is a cross-sectional view of a modified form of the embodiment shown in FIG. 5.

Referring now to FIG. 7, modifications to enhance the water resistance of the joint directly beneath the cover plate are illustrated. The watertight properties of an impregnated expanding foam sealant both to the left and right of the T piece may be enhanced by the creation of a double seal at the upper surface level of the impregnated expanding foam sealant closest to the cover/slide plate. This may be achieved through the use of a low modulus or ultra low modulus sealant 10 being applied to this surface layer. The use of an ultra low modulus sealant (such as Dow Coming 890 RTV Silicone Sealant) will provide the surface of the impregnated expanding foam sealant 3 with a closed cell finish and additional sealant layer which will reduce the depth requirement of the impregnated expanding foam sealant beneath the low modulus sealant. In addition, the use of the correctly chosen wet sealant adhered to both the central spline and joint substrate will enhance the elastic properties of the double seal configuration. In the FIG. 7 configuration, the impregnated expanding foam sealant 3 will act as the primary return force or memory, while the ultra low modulus sealant will act as the primary watertight barrier, while also enhancing the return force or memory of the composite seal. It can be seen from this configuration that if this ultra low modulus sealant is applied in a self-levelling format, after the impregnated expanding foam sealant has been placed in the joint and allowed to recover to joint size, that a watertight element is obtained in terms of adhesion to the substrates.

The FIG. 7 installation is effected firstly by the installation of the T piece with impregnated expanding foam sealant applied to both sides of the T piece or central spline. This assembly is adhered to the joint faces by means of a suitable adhesive and allowed to recover from its pre-compressed delivery and installation format. After recovery of the pre-compressed impregnated expanding foam sealant, the ultra low modulus self-leveling sealant (or other suitable sealant) is applied to the top exposed surface of the impregnated expanding foam sealant on either side of the central spline. Once the sealant has been applied, a level may be applied across the top surface of the joint to correctly align the brackets and cover plate/slide plate. The cover/slide plate 4 is then screwed into position.

Figure 8:
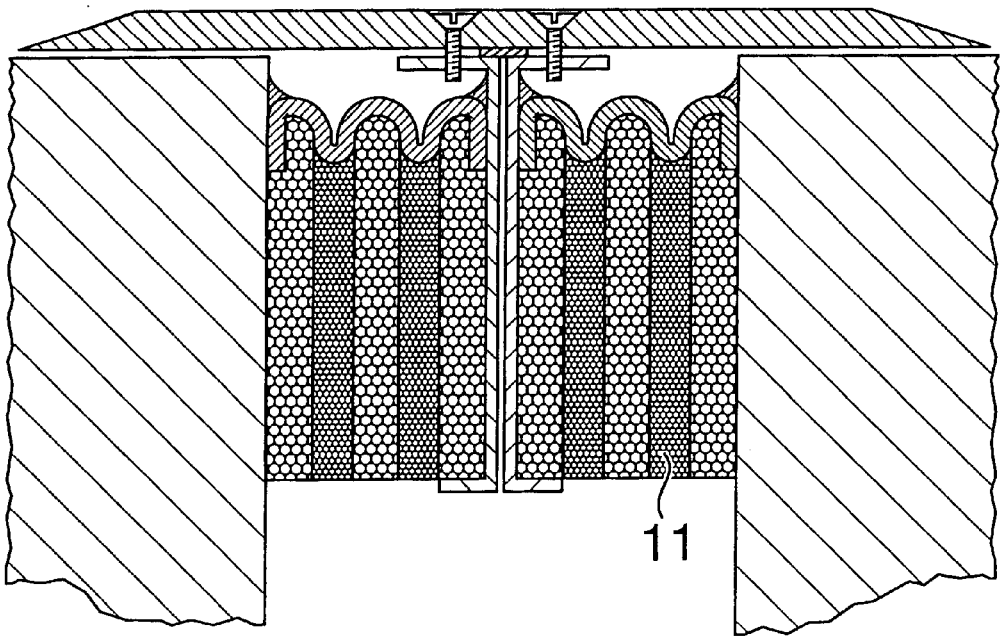
FIG. 8 is a cross-sectional view of another modified form of the embodiment shown in FIG. 5.

FIG. 8 shows a further modification and makes use of a prepackaged product 11 consisting of layers of compressible and non-compressible foam, with a sealant applied to the top surface thereof, sold under the trade mark COLORSEAL, by Emseal Corporation. In the case of the use of the Colorseal product, a finishing of the detail will require that a corner or "heel" bead be applied between the substrate and the Colorseal product to effect the proper chemical termination and adhesion of the top sealant to the substrate.

It can be seen from FIGS. 7 and 8 that the system can be extended to utilize interleaving layers of impregnated expanding foam sealant and closed cell foam or other resilient material to assist in the recovery and stability of the composite structure that is placed on either side of the central spline. In other words, a composite matrix may be utilized as the return or recovery force on either side of the central spline. The prime requirement is that the material to be inserted into the joint is capable of being pre-compressed and holding this pre-compression during the time taken to install the material correctly into the joint. So, a series of both differing densities of impregnated expanding foam sealant and closed cell foam may be used to provide the recovery force. This recovery force and the composition of the structure will, to a large extent, depend on the size (width) of joint to be formed together with the performance characteristics required from the joint (such as seismic or thermal movement characteristics, etc.)

Figure 9:
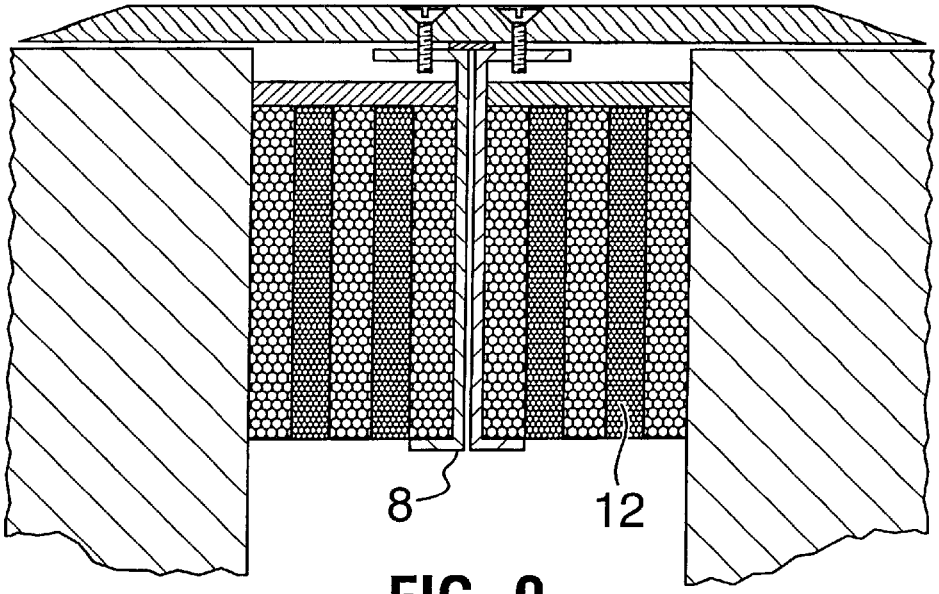
FIG. 9 is a cross-sectional view of a further modified form of the embodiment shown in FIG. 5.
Figure 10:
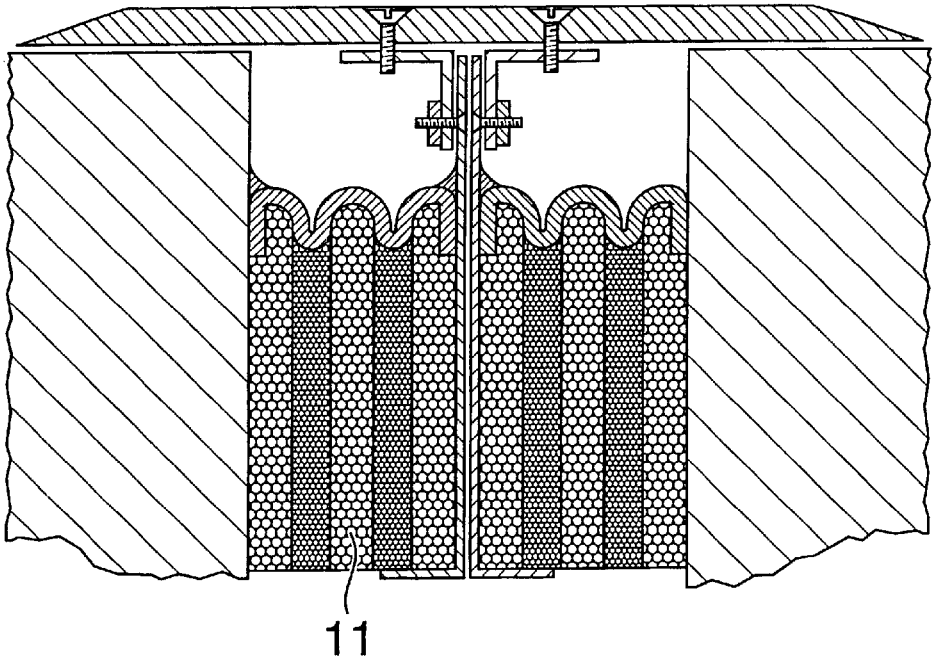
FIG. 10 is a cross-sectional view of a modified form of the embodiment shown in FIG. 6.

It will be observed from FIGS. 9 and 10 that further combinations are possible. FIG. 9 illustrates a form of the present invention utilizing a split central T-piece similar to that shown in FIGS. 5 and 7, with a layered compressible and non-compressible foam layers, available from Emseal Corporation under the trade mark BACKERSEAL 12 applied on each side of the T-piece, and a low modulus wet sealant applied in the field on the top surface of same, after it has expanded on each side to centre the T-piece.

FIG. 10 illustrates a modification of the FIG. 6 form of the invention, described in full above, but utilizing the COLORSEAL product 12 as a centring means on each side of the T.

The cover/slide plate construction may be chosen from the metallic group of materials including stainless steel, bronze, brass, aluminum, galvanized or plated steel, etc. The main criterion for the choice of material is the allowable degree of flexing that is undergone during the passage of vehicular or pedestrian traffic while the material still retains its ability to bridge the joint in the manner required by the design engineer. In addition, the material should display corrosion-resistant properties if used in an external environment. Thus, the larger the joint that must be spanned by the cover/slide plate, the more rigid the material. Conversely, as the gap to be spanned becomes narrower, the distance between the joint faces is less and alternate materials may be used, such as thermo-plastics or thermo-plastic alloys (elastomers). The main criteria for the use of such alloys are impact resistance, rigidity in load transfer, and temperature resistance if exposed to an external environment. It can thus also be seen that the cover/slide plate may also be constructed from composite materials such as fiber resins.

Thus, the final choice of material will depend on joint width, load transfer, and structural integrity of the joint assembly.

The sub-assembly beneath cover/slide plate may be chosen from the group of metals including steel, aluminum, brass and bronze, which may be extruded or rolled to form the necessary sections. The material should display corrosive-resistance properties in accordance with the environment in which it will operate (interior/exterior). However, the choice of material may also include rigid plastics, thermo-plastic alloys, and co-extrusions that are able to be fastened to the cover/slide plate and provide the cover/slide plate with sufficient retention and movement capability in relation to the movements being experienced by the joint.

The preferable choice of material would be aluminum extrusions.

It is to be understood that the examples described above are not meant to limit the scope of the present invention, it is expected that the numerous variants will be obvious to one skilled in the field of joint seal design without any departure from the spirit of the invention. The intended claims, properly construed, form the only limitation on the scope of the invention.

I claim:

1. A seismic/expansion joint seal and cover comprising:

a cover plate;

a central spine extending downwardly from said cover plate, said cover is detachable from said spine, said cover is screwed to said spine; and at least one layer of a resilient compressible foam sealant on each side of said spine, said spine is composed of two mirror-image generally C-shaped members, each of which has a lower base flange, an upper base flange into which said cover is screwed, and a flat web extending between the flanges, against which said foam sealant is positioned, said upper flange of each said C-shaped members is the laterally extending portion of a right angle member that is affixable to said web at selected heights.

2. A joint seal and cover as claimed in claim 1, wherein said C-shaped members are separated by a strip of incompressible foam.

3. A joint seal and cover as claimed in claim 1, wherein a bead of sealant is applied between said spine and said cover.

4. A seismic/expansion joint seal and cover comprising:

a cover plate;

a central spine extending downwardly from said cover plate; and at least one layer of a resilient compressible foam sealant on each side of said spine, said compressible foam layer has a low modulus elastomeric sealant applied to the top surface thereof.

5. A joint seal and cover as claimed in claim 4, wherein a bead of sealant is applied between said spine and said cover.

6. A seismic/expansion joint seal and cover comprising:

a cover plate;

a central spine extending downwardly from said cover plate, said cover is detachable from said spine; and at least one layer of a resilient compressible foam sealant on each side of said spine, said compressible foam layer has a low modulus elastomeric sealant applied to the top surface thereof.

7. A seismic/expansion joint seal and cover comprising:

a cover plate;

a central spine extending downwardly from said cover plate, said cover is detachable from said spine, said cover is screwed to said spine; and at least one layer of a resilient compressible foam sealant on each side of said spine, said spine is composed of two mirror-image generally C-shaped members, each of which has a lower base flange, an upper base flange into which said cover is screwed, and a flat web extending between the flanges, against which said foam sealant is positioned, said compressible foam layer has a low modulus elastomeric sealant applied to the top surface thereof.

8. A seismic/expansion joint seal and cover comprising:

a cover plate;

a central spine extending downwardly from said cover plate, said cover is detachable from said spine, said cover is screwed to said spine; and at least one layer of a resilient compressible foam sealant on each side of said spine, said spine is composed of two mirror-image generally C-shaped members, each of which has a lower base flange, an upper base flange into which said cover is screwed, and a flat web extending between the flanges, against which the said foam sealant is positioned, said compressible foam layer has a low modulus elastomeric sealant applied to the top surface thereof, said C-shaped members are separated by a strip of incompressible foam.

* * * * *

US006532708C1

(12) EX PARTE REEXAMINATION CERTIFICATE (10834th)

United States Patent

Baerveldt

(10) Number: US 6,532,708 C1

(45) Certificate Issued: Mar. 23, 2016

(54) EXPANSION AND SEISMIC JOINT COVERS

(75) Inventor: Konrad Baerveldt, Toronto (CA)

(73) Assignee: EMSEAL JOINT SYSTEMS LTD., Westborough, MA (US)

Reexamination Request:
No. 90/013,473, Mar. 24, 2015
No. 90/013,472, Apr. 3, 2015

Reexamination Certificate for:

| | |
|---|---|
| Patent No.: | **6,532,708** |
| Issued: | **Mar. 18, 2003** |
| Appl. No.: | **09/654,932** |
| Filed: | **Aug. 31, 2000** |

(30) Foreign Application Priority Data

Jan. 18, 2000 (CA) ..... 2296228

(51) Int. Cl.

| | |
|---|---|
| ***E04B 1/682*** | (2006.01) |
| ***E04B 1/68*** | (2006.01) |
| ***E01D 19/06*** | (2006.01) |

(52) U.S. Cl.
CPC ..... *E04B 1/6804* (2013.01); *E01D 19/06* (2013.01)

(58) Field of Classification Search
CPC ..... E01C 11/126; E01C 11/02; E01D 19/06; E01D 19/062; E04B 1/6803; E04B 1/6812; E04B 1/6816
USPC ..... 404/47, 49, 55, 67, 68, 69, 54; 52/396.03, 396.04, 396.05, 396.06, 52/393
See application file for complete search history.

(56) References Cited

To view the complete listing of prior art documents cited during the proceedings for Reexamination Control Numbers 90/013,473 and 90/013,472, please refer to the USPTO's public Patent Application Information Retrieval (PAIR) system under the Display References tab.

*Primary Examiner* — Russell Stormer

(57) ABSTRACT

A seismic/expansion joint seal and cover comprises a cover plate, and a central spine extending downwardly from said cover plate. At least one layer of a resilient compressible foam sealant is provided on each side of the spine.

At the time of issuance and publication of this certificate, the patent remains subject to pending reexamination control number 90/013,683 filed Jan. 19, 2016. The claim content of the patent may be subsequently revised if a reexamination certificate issues from the reexamination proceeding.

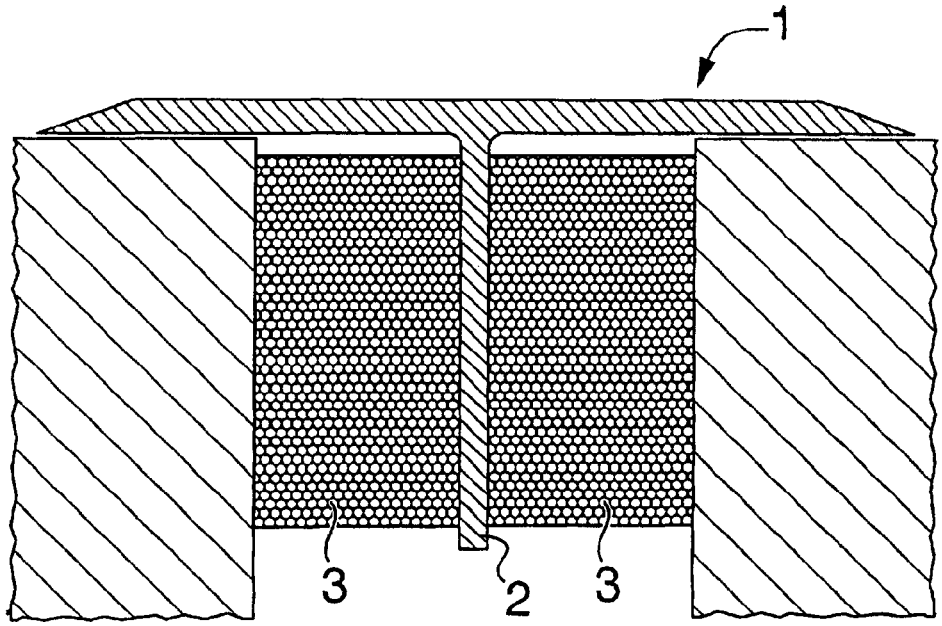

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-3, 7 and 8 is confirmed.

Claims 4 and 6 are determined to be patentable as amended.

Claim 5, dependent on an amended claim, is determined to be patentable.

New claims 9-28 are added and determined to be patentable.

4. A seismic/expansion joint seal and cover comprising:

a cover plate;

a central spine extending downwardly from said cover plate *and positioned in a joint between substrates such that said cover plate overlies said joint, said central spine having a first side and a second side*; and at least one *first* layer of a resilient compressible foam sealant *disposed* on [each side of] said *first side of said central spine between said central spine and a first of said substrates and at least one second layer of said resilient compressible foam sealant disposed on said second side of said central* spine *between said central spine and a second of said substrates, said first layer and said second layer of said resilient compressible foam sealant are configured to substantially maintain said position of said central spine in said joint without support below said central spine when said cover plate is detached from said central spine, each layer of* said compressible foam sealant [layer] has a low modulus elastorneric sealant applied to the top surface thereof*;*

*wherein said central spine and said first layer and said second layer of resilient compressible foam sealant are configured to accommodate movement of said substrates by said first layer and said second layer of said resilient compressible foam sealant compressing and expanding in relation to said movement and providing a force to said central spine such that said central spine remains substantially centered in said joint and said cover plate remains substantially centered over said joint*.

6. A seismic/expansion joint seal and cover comprising:

a cover plate;

a central spine extending downwardly from said cover plate *and positioned in a joint between substrates such that said cover plate overlies said joint, said central spine having a first side and a second side*, said cover *plate* is detachable from said *central* spine; and at least one *first* layer of a resilient compressible foam sealant *disposed* on [each side of] said *first side of said central spine between said central spine and a first of said substrates and at least one second layer of said resilient compressible foam sealant disposed on said second side of said central* spine *between said central spine and a second of said substrates, said first layer and said second layer of said resilient compressible foam sealant are configured to support said central spine substantially vertically in said joint without additional support below said central spine when said cover plate is detached from said central spine, each layer of* said compressible foam [layer] *sealant* has a low modulus elastomeric sealant applied to the top surface thereof*;*

*wherein said central spine and said first layer and said second layer of resilient compressible foam sealant are configured to accommodate movement of said substrates by said first layer and said second layer of said resilient compressible foam sealant compressing and expanding in relation to said movement and providing a force to said central spine such that said central spine remains substantially centered in said joint and said cover plate remains substantially centered over said joint*.

*9. A joint seal and cover as claimed in claim 4, wherein said first layer and said second layer of resilient compressible foam sealant further include at least one non-compressible foam sealant layer to form a composite foam sealant structure.*

*10. A joint seal and cover as claimed in claim 9, wherein said compressible and non-compressible layers of foam sealant of said composite foam sealant structure are configured of differing densities such that a recovery force of said composite foam sealant structure compressing and expanding in relation to said movement of said substrates depends on a width of said joint and performance characteristics of said composite foam sealant structure including an ability of said recovery force to accommodate seismic and thermal movement of said substrates.*

*11. A joint seal and cover as claimed in claim 4, wherein a length that said central spine extends downwardly from said cover late in said joint is dependent on dimensions of said joint and on a size of said first layer and said second layer of resilient compressible foam sealant.*

*12. A joint seal and cover as claimed in claim 4, further including an angular portion that is affixable to said central spine and said cover plate at selected heights to laterally extend a length that said central spine extends downwardly from said cover plate.*

*13. A joint seal and cover as claimed in claim 4, wherein said central spine is configured to bound an end of said first layer of compressible foam sealant opposite said first substrate against said first side of said central spine and to bound an end of said second layer of compressible foam sealant opposite said second substrate against said second side of said central spine.*

*14. A joint seal and cover as claimed in claim 4, wherein said first layer and said second layer of resilient compressible foam sealant are impregnated, and said impregnated compressible foam sealant layers and said low modulus elastomeric sealant applied thereto provide a double seal of water resistance of said joint directly below said cover plate.*

*15. A joint seal and cover as claimed in claim 4, wherein said cover plate is configured of material that has impact resistance and rigidity in load transfer to undergo at least one of vehicular and pedestrian traffic.*

*16. A joint seal and cover as claimed in claim 4, wherein said low modulus elastomeric sealant provides a closed cell finish to said top surface of said compressible foam sealant.*

*17. A joint seal and cover as claimed in claim 4, wherein said low modulus elastomeric sealant provides a watertight barrier on said compressible foam sealant.*

*18. A joint seal and cover as claimed in claim 4, wherein said central spine further includes a lower base surface, an upper base surface into which said cover plate is detachable, and a web extending between said lower base surface and said upper base surface said first layer and said second layer*

*of compressible foam sealants being positioned against said web and supported by said lower base surface.*

*19. A joint seal and cover as claimed in claim 6, wherein said first layer and said second layer of resilient compressible foam sealant further include at least one non-compressible foam sealant layer to form a composite sealant structure.*

*20. A joint seal and cover as claimed in claim 19, wherein said compressible and non-compressible layers of said composite foam sealant structure are configured of differing densities such that a recovery force of said composite foam sealant structure compressing and expanding in relation to said movement of said substrates depends on a width of said joint and performance characteristics of said composite foam sealant structure including an ability of said recovery force to accommodate seismic and thermal movement of said substrates.*

*21. A joint seal and cover as claimed in claim 6, wherein a length that said central spine extends downwardly from said cover plate in said joint is dependent on dimensions of said joint and on a size of said first layer and said second layer of resilient compressible foam sealant.*

*22. A joint seal and cover as claimed in claim 6, further including an angular portion that is affixable to said central spine and said cover plate at selected heights to laterally extend a length that said central spine extends downwardly from said cover plate.*

*23. A joint seal and cover as claimed in claim 6, wherein said central spine is configured to bound an end of said first layer of compressible foam sealant opposite said first substrate against said first side of said central spine and to bound an end of said second layer of compressible foam sealant opposite said second substrate against said second side of said central spine.*

*24. A joint seal and cover as claimed in claim 6, wherein said first layer and said second layer of resilient compressible foam sealant are impregnated, and said impregnated compressible foam sealant layers and said low modulus elastomeric sealant applied thereto provide a double seal of water resistance of said joint directly below said cover plate.*

*25. A joint seal and cover as claimed in claim 6, wherein said cover plate is configured of material that has impact resistance and rigidity in load transfer to undergo at least one of vehicular and pedestrian traffic.*

*26. A joint seal and cover as claimed in claim 6, wherein said low modulus elastomeric sealant provides a closed cell finish to said top surface of said compressible foam sealant.*

*27. A joint seal and cover as claimed in claim 6, wherein said low modulus elastomeric sealant provides a watertight barrier on said compressible foam sealant.*

*28. A joint seal and cover as claimed in claim 6, wherein said central spine further includes a lower base surface, an upper base surface into which said cover plate is detachable, and a web extending between said lower base surface and said upper base surface, said first layer and said second layer of compressible foam sealants being positioned against said web and supported by said lower base surface.*

* * * * *

US006532708C2

(12) EX PARTE REEXAMINATION CERTIFICATE (10878th)

United States Patent

Baerveldt

(10) Number: US 6,532,708 C2

(45) Certificate Issued: Jun. 7, 2016

(54) EXPANSION AND SEISMIC JOINT COVERS

(75) Inventor: Konrad Baerveldt, Toronto (CA)

(73) Assignee: EMSEAL JOINT SYSTEMS LTD., Westborough, MA (US)

Reexamination Request:
No. 90/013,683, Jan. 19, 2016

Reexamination Certificate for:

| | |
|---|---|
| Patent No.: | **6,532,708** |
| Issued: | **Mar. 18, 2003** |
| Appl. No.: | **09/654,932** |
| Filed: | **Aug. 31, 2000** |

Reexamination Certificate C1 6,532,708 issued Mar. 23, 2016

(30) Foreign Application Priority Data

Jan. 18, 2000 (CA) ..... 2296228

(51) Int. Cl.

| | |
|---|---|
| ***E04B 1/682*** | (2006.01) |
| ***E04B 1/68*** | (2006.01) |
| ***E01D 19/06*** | (2006.01) |

(52) U.S. Cl.
CPC ..... *E04B 1/6804* (2013.01); *E01D 19/06* (2013.01)

(58) Field of Classification Search
CPC ..... E04B 1/6804; E01D 19/06
USPC ..... 52/396.03, 396.04, 396.05, 396.06; 404/47, 49, 55, 67, 68, 69
See application file for complete search history.

(56) References Cited

To view the complete listing of prior art documents cited during the proceeding for Reexamination Control Number 90/013,683, please refer to the USPTO's public Patent Application Information Retrieval (PAIR) system under the Display References tab.

*Primary Examiner* — Russell D. Stormer

(57) ABSTRACT

A seismic/expansion joint seal and cover comprises a cover plate, and a central spine extending downwardly from said cover plate. At least one layer of a resilient compressible foam sealant is provided on each side of the spine.

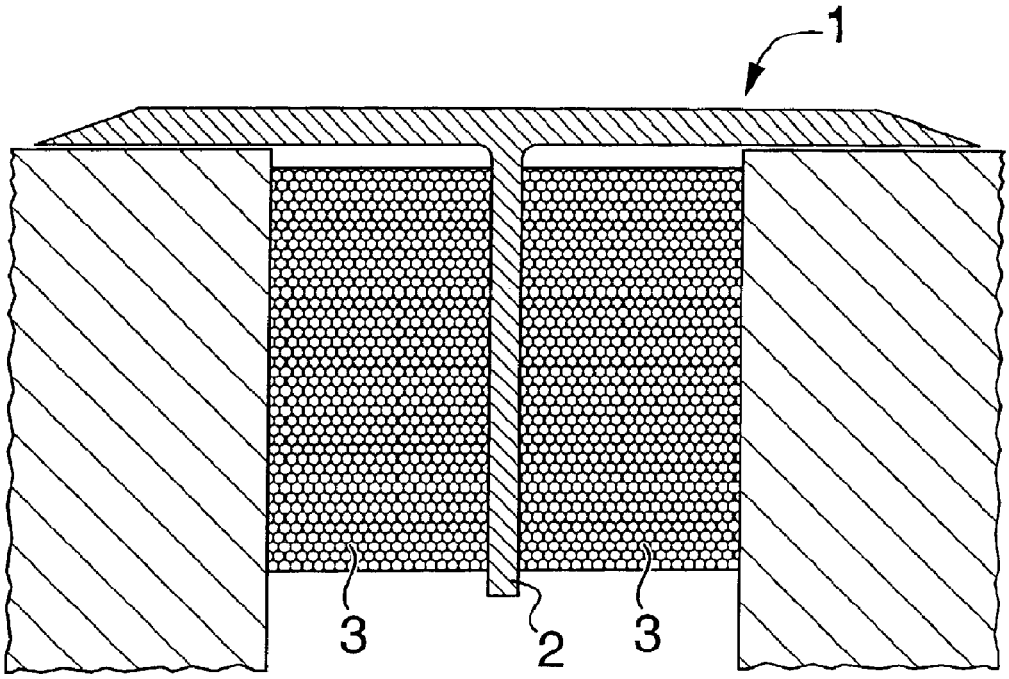

EX PARTE REEXAMINATION CERTIFICATE

NO AMENDMENTS HAVE BEEN MADE TO THE PATENT

AS A RESULT OF REEXAMINATION, IT HAS BEEN DETERMINED THAT:

The patentability of claims 4-8 is confirmed.

Claims 1-3 and 9-28 were not reexamined.

* * * * *